United States Patent [19]

Brightwell

[11] Patent Number: 4,715,162

[45] Date of Patent: Dec. 29, 1987

[54] WOODEN JOIST WITH WEB MEMBERS HAVING CUT TAPERED EDGES AND VENT SLOTS

[75] Inventor: Lionel L. Brightwell, Boise, Id.

[73] Assignee: Trus Joist Corporation, Boise, Id.

[21] Appl. No.: 816,568

[22] Filed: Jan. 6, 1986

[51] Int. Cl.[4] ..... E04C 3/12

[52] U.S. Cl. ..... 52/729; 52/730

[58] Field of Search ..... 52/729, 730, 731, 690, 52/693

[56] References Cited

U.S. PATENT DOCUMENTS

| | | | |
|---|---|---|---|
| 1,377,891 | 5/1921 | Knight | 52/730 |
| 2,702,926 | 3/1955 | Rahaim . | |
| 3,490,188 | 1/1970 | Troutner . | |
| 4,336,678 | 6/1982 | Peters . | |
| 4,413,459 | 11/1983 | Lambuth | 52/729 |
| 4,456,497 | 6/1984 | Eberle | 52/729 X |

FOREIGN PATENT DOCUMENTS

| | | | |
|---|---|---|---|
| 2334524 | 2/1974 | Fed. Rep. of Germany | 52/693 |

*Primary Examiner*—Carl D. Friedman
*Assistant Examiner*—Richard E. Chilcot, Jr.
*Attorney, Agent, or Firm*—Klarquist, Sparkman, Campbell, Leigh & Whinston

[57] ABSTRACT

A wooden joist is described which includes a pair of flange members each having a tapered groove therein and a web member with two tapered outer edges that are glued into such grooves. The tapered outer edges are formed by cutting with a rotating cutter head to provide such edges of substantially uncompressed wood. Glue vent slots are provided at positions spaced along the length of such edges to allow glue to escape from the grooves by flowing through such vent slots. The vent slots are cut to a uniform depth into the sides of the tapered edges by feeding the web member between two pairs of cutting wheels each having raised cutter projections spaced along the surface of the wheel and extending at the same angle as the sides of the tapered edges. Preferably, the web member is made of oriented strand board, while the flange members may be made of laminated veneer lumber.

9 Claims, 12 Drawing Figures

WOODEN JOIST WITH WEB MEMBERS HAVING CUT TAPERED EDGES AND VENT SLOTS

BACKGROUND OF THE INVENTION

The subject matter of the present invention relates generally to wooden structural support members such as wooden joists, trusses or I-beams. The wooden joists are formed with two flange members having tapered grooves in their facing surfaces and joined together by a closed web including wooden web members having tapered outer edges which are glued into such grooves. Such a wooden joist can be employed as a structural support member in a building, a bridge or other structure.

Previously it has been suggested in U.S. Pat. No. 3,490,188 of Troutner issued Jan. 20, 1970 to provide a wooden joist or truss of the above-described closed web type which employs two tapered edges formed by compression of the edges on the opposite sides of the web member beyond their elastic limit. The compressed tapered edges absorb water or other solvent in the glue to cause swelling of such edges which results in a wedging pressure between the tapered edges of the web and the chord members. While, for most purposes this structure has proved satisfactory, the wood fibers are damaged during compression to form the tapered edges which weakens the joint. However, such compressed joist cannot be employed when using oriented strand board for the web member since compression of such board beyond its elastic limit breaks the edge of the board. Also only a small amount of water or solvent is absorbed in the compressed oriented strand board, so there is no appreciable expansion.

In addition, it has been proposed in U.S. Pat. No. 4,336,678 of Peters issued June 29, 1982 to provide an I-beam truss structure or joist of the above-mentioned closed web type in which the web member is made of plywood whose tapered edges are formed by compression of such plywood which may vary in thickness, + or −1/16 inch. Glue vents are formed by pressing the compressed tapered edges of the web member in order to further compress such edges at spaced positions on the edges to form glue vents. Such compression is apparently beyond the elastic limit of the wood material which weakens the web member. Also, because of the thickness variations of standard commercial plywood, the web is of non-uniform thickness and density which further reduces the strength of the joint. The glue vents are preferably formed as scallops by means of eccentric compression rollers so that the depth of the glue vent varies along its length. As a result, such compressed glue vents reduce in depth to a minimum adjacent the top of the groove and, therefore are not sufficient in transmitting the flow of glue out of the grooves in the flange members. Also the glue is provided in the bottom of the grooves and does not spread uniformly over the sides of the groove and the tapered edges.

The wooden truss of the present invention employs web members whose tapered outer edges are formed by cutting, not compression, to provide stronger web members. Also the plurality of vent slots spaced longitudinally along such edges are formed by cutting so that such vent slots are of substantially uniform depth along the entire length of the slot. The result is a more uniform distribution of glue on the sides of the grooves of the flange members and over the surface of the tapered edges of the web member. This provides a much stronger bond between the web member and the flange members which in turn provides a stronger joist apparatus. In addition, the method of manufacture of a joist in accordance with the present invention enables oriented strand board or plywood of cut accurate dimensions to be employed for the web member which insures that a strong glue bond is formed between the web member and the flange member.

SUMMARY OF INVENTION

It is therefore one object of the present invention to provide an improved wooden joist or other structural member of closed web type and method of manufacture in which a stronger joint is formed between the tapered edges of the web member and the tapered groove of the flange members joined thereto.

Another object of the invention is to provide such an improved joist apparatus and method of manufacture in which vent slots are cut into uncompressed tapered edges of the web member to provide such slots with substantially uniform depth throughout the entire length of such slots for more efficient glue venting.

A further object of the invention is to provide such an improved truss apparatus and method of manufacture in which the web member is formed with tapered edges by cutting such web member so that such tapered edges are not compressed beyond the elastic limit of the wood material.

An additional object of the present invention is to provide such an improved truss apparatus and method of manufacture in which the glue is deposited on the sides of the grooves in the flanges for more uniform distribution of the glue and a stronger joint.

Still another object of the present invention is to provide such an improved wooden truss apparatus and method of manufacture in which the bottom end of the tapered edge on the web member is spaced from the bottom of the groove in the flange member by a clearance space in order to enable a stronger glue bond between the web member and the chord member.

A still further object of the present invention is to provide an improved method of manufacture of a wooden truss apparatus in which the the web member is made of oriented strand board.

DESCRIPTION OF DRAWINGS

Other objects and advantages of the present invention will be apparent from the following detailed description of a preferred embodiment therein and from the attached drawings of which.

DETAILED DESCRIPTION OF PREFERRED EMBODIMENT

Figure 3:
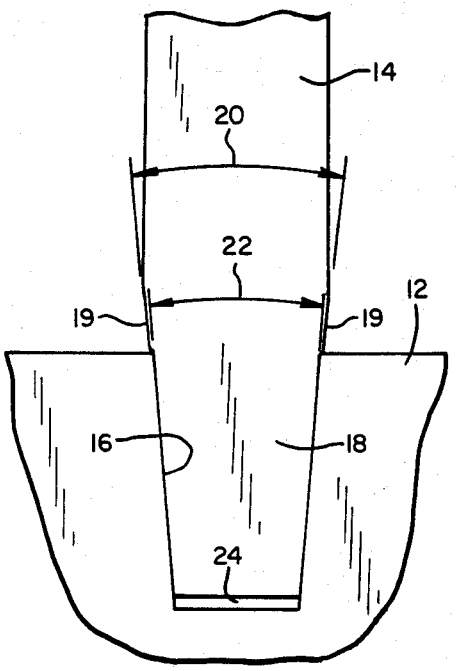
FIG. 3 is an enlarged vertical section view taken along the line 3—3 of FIG. 2 showing the tapered edge of the web member and the tapered groove of the flange member of such truss apparatus.
Figure 1:
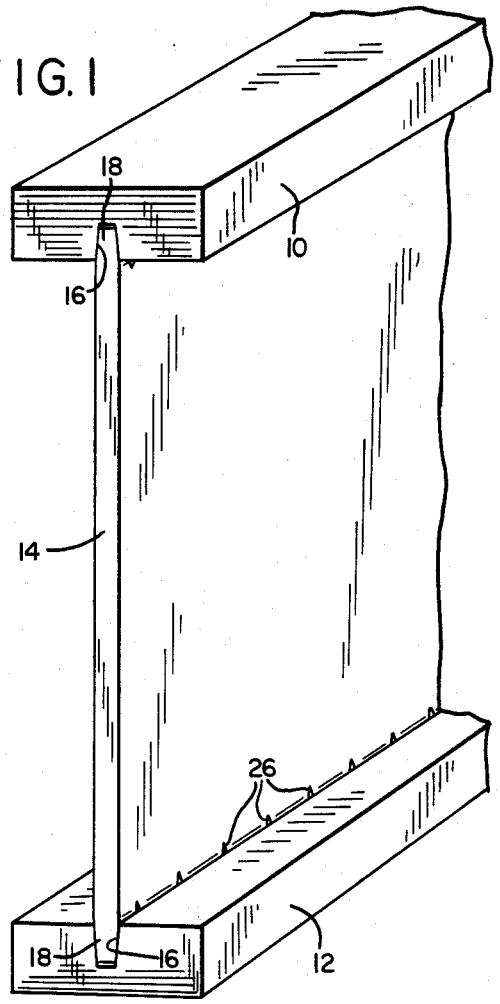
FIG. 1 is an enlarged perspective view of one end of a joist apparatus made in accordance with the present invention.
Figure 2:
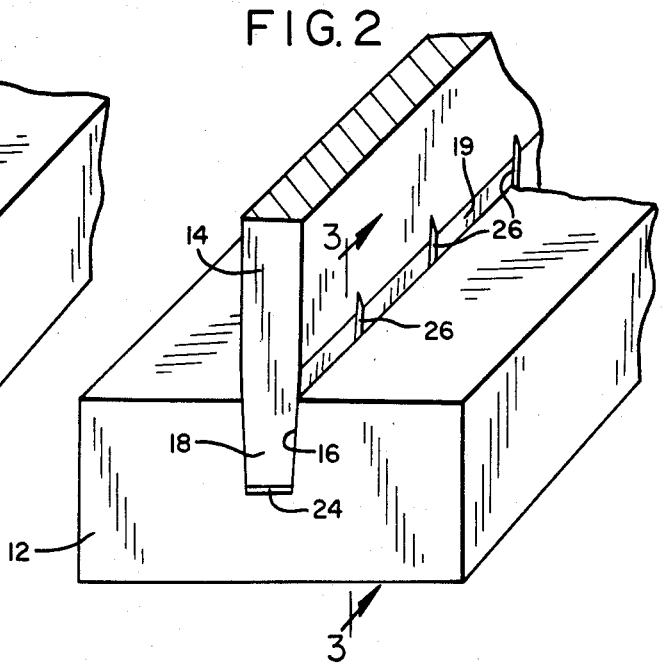
FIG. 2 is an enlarged oblique elevation view of the lower portion of the end of the joist apparatus of FIG. 1.

As shown in FIGS. 1, 2 and 3, a wooden structural member of closed web type such as a joist or I-beam made in accordance with the present invention includes a pair of upper and lower flange members 10 and 12 connected by a wooden web member 14. The flange members 10 and 12 may be made of laminated veneer lumber or standard 2"×4" lumber, and are each provided with a tapered longitudinal groove 16 which extends the entire length of such flange members, such grooves facing each other for the receipt of the opposite side edges 18 of the web. The top and bottom edges 18 of the web 14 are tapered so that they gradually decrease in width with distance toward the outer end of such side edges. In a preferred embodiment of the invention, the opposite sides 19 of the tapered edge 18 enclose an angle 20 of 6° and 20 minutes. The opposite sides of the groove 16 are also tapered by an angle 22 of 6° and 0 minutes, somewhat less than that of the sides of the tapered edge 16.

The groove 16 is formed by routing a groove in each flange member 10 and 12 to a depth of, for example, ⅝ inch or 0.625 inch. However, the height of the tapered edge 18 is greater and may be 0.690 inch. Also, the width of the groove 16 at the bottom thereof may be 0.327 inch, while the width of the outer end of the tapered edge 18 may be somewhat greater or 0.337 inch . The width of the top of the groove 16 may be 0.393 inches, while the width of the tapered edge 18 at a height of 0.625 inch is somewhat greater in width or about 0.405 inch. It should be noted that for the above example the width of the web 14 at its maximum width is about 0.410 inch. Therefore, when the tapered edge 18 is inserted into the groove 16, an interference fit occurs which clamps the web member within the groove of the flanges 12. However, the opposite sides 19 of the tapered edges 18 of the web are not compressed beyond the elastic limit of the wood material of such web which may be made of oriented strand board or plywood, so that the wood is not damaged and the strength of the web member is not reduced by such interference fit. It should be noted that the maximum width of the web member and the height of the tapered edge may vary. For example, the maximum thickness of the web may be up to 0.490 inch, the height of the tapered edge 18 may be up to 2.14 inch, while the minimum width of such tapered edge is still the same 0.337 inch. Also, it should be noted that a spacing 24 of about 1/32 or 0.031 inch may be provided between the outer end of the tapered edge 18 and the bottom of the groove 16 to insure a tight fit and to allow glue to flow into such space.

Figure 4:
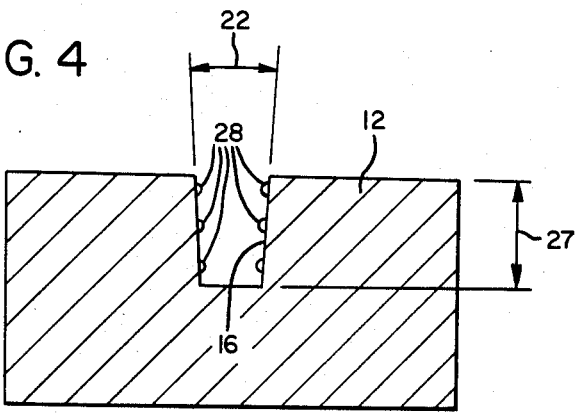
FIG. 4 is section view of the flange member after glue has been applied to the sides of the tapered groove.

A plurality of glue vent slots 26 are provided at positions spaced along the length of the groove 16, by cutting such vents in the tapered edge 18 of the web member 14. Thus, the vent slots 26 may be spaced apart approximately 1½ inches and extend perpendicular to the bottom of the groove 16. The vent slots 22 extend over the top of the groove 16 and preferably the entire height of the tapered edge 18. This enables glue to escape out of the groove 16 and flow through the vent slots 26 to prevent excess pressure which may tend to force the web out of the groove. As shown in FIG. 4, the groove 16 is formed in the flanges 10 and 12 by routing to form the tapered groove 16 whose opposite sides are tapered at an acute angle 22, for example, of 6° and 0 minutes to a depth 27 of ⅝ inches. Also immediately prior to bonding, three beads of glue 28 are applied to each side of the groove 16, such beads being spaced apart for more uniform coating of glue over the sides 19 of the tapered edge 18 when the web is inserted into the groove.

Figure 7:
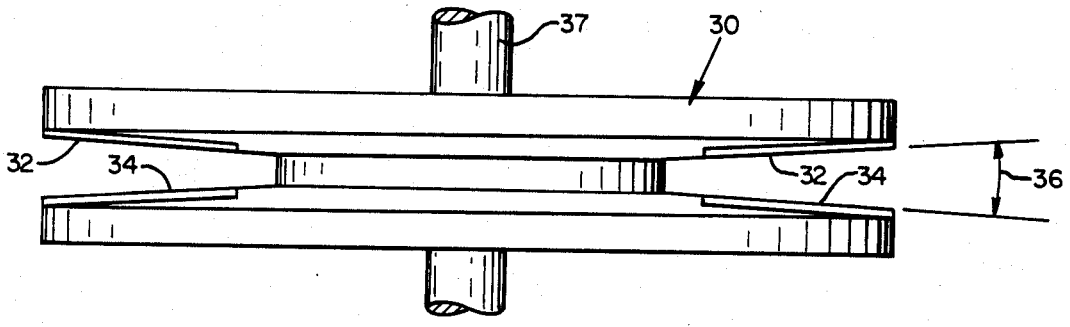
FIG. 7 is a elevation view of the rotating cutter head used to cut the two tapered edges on the web member.

As shown in FIG. 7, the web member 14 is formed with tapered edges 18 by cutting the opposite edges of the web member with a rotating cutter head 30. The cutter head includes an upper cutter blade 32 and a lower cutter blade 34 spaced apart by a tapered spacing whose opposite sides are separated by an angle 36 of 6° and 20 minutes to cut the same final angle 20 in the tapered edge 18 as shown in FIG. 3. The cutter head 30 is mounted on a power driven rotating shaft 37 and the web member 14 is fed through two such cutter heads in order to cut the tapered edge 18 on the opposite sides of such web by the upper and lower cutter blades 32 and 34.

Figure 8:
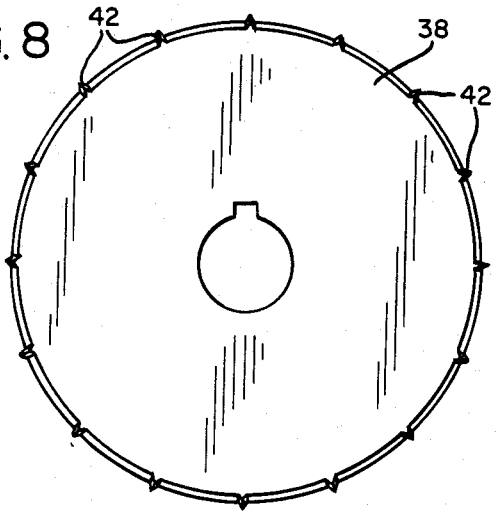
FIG. 8 is an end view of one of the cutting rollers employed in FIG. 5 to form the vent slots in the tapered edges of the web member.
Figure 9:
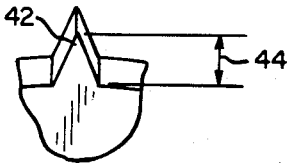
FIG. 9 is an enlarged view of one of the cutting projections extending from the outer surface of the cutting roller of FIG. 8.
Figure 5:
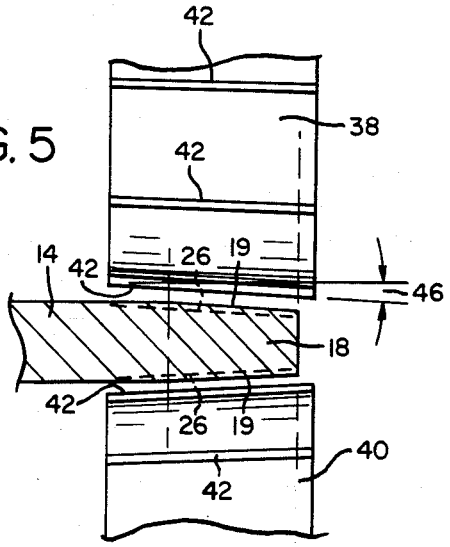
FIG. 5 is an enlarged view of the tapered edge of the web member as vent slots are being cut in such tapered edge by cutting rollers.

As shown in FIGS. 5, 8 and 9, the vent slots 26 are cut in the tapered edge 18 of the web member 14 by means of rotating cutter rolls 38 and 40. The cutter rolls have cutter projections 42 provided at uniformly spaced positions on the outer surfaces of such rolls which are spaced apart sufficiently to provide the spacing of 1½ inches between vent slots 26 in FIG. 2. As shown in FIG. 9, the cutting projections 42 are of a triangular cross-section shape having a height 44 of about 0.10 inch. The top of the cutter projection 42 has a radius of curvature of about 1/32 inch or 0.031 inch. The cutter projections 42 extend longitudinally across the outer face of the cutter roll at an angle 46 of 3° and 10 minutes with respect to the horizontal axis of rotation of the cutter rollers. Thus, the angle of the vent slots 26 cut by inch projections is equal to the angle of the opposite sides of the tapered edge 18. As a result, the vent slots 26 are of substantially uniform depth along the entire length of the slots.

Figure 6:
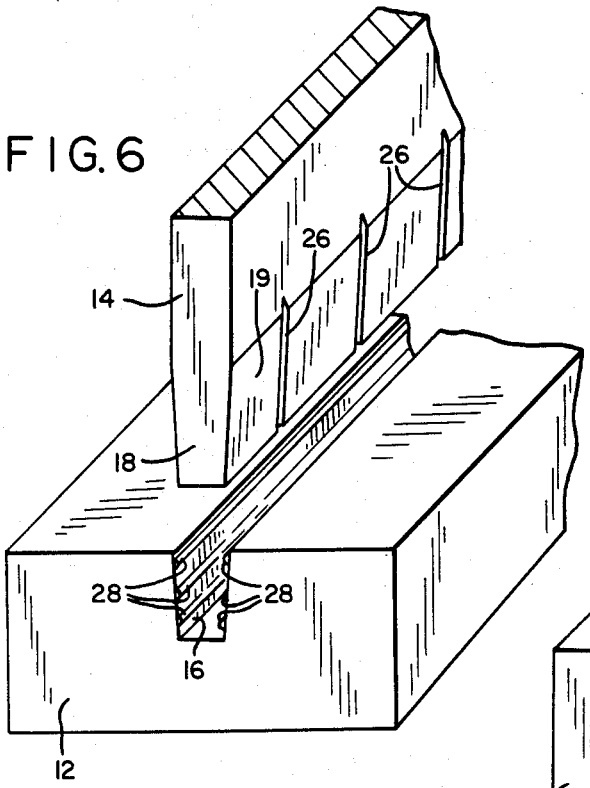
FIG. 6 is a view showing the assembly of the grooved flange members and the tapered edge of the web member after vent slots have been formed in such web member and glue has been applied to the side surfaces of the groove in the chord member in accordance with FIGS. 4 and 5.

As shown in FIG. 6, after the vent slots 26 are cut in the tapered edges 18 of web member 14 and the glue beads 28 are coated on the sides of the groove 16 in the two flange members 10 and 12, the web member is inserted into the grooves of both of such flange members. As a result, the glue beads 28 are spread as a substantially uniform coating across the surfaces of the sides of tapered edges 18 and the groove 16 and, in some cases, into the bottom of the groove. Any excess glue within the groove 16 is allowed to escape by flowing upward through the vent slots 26 and out of the groove so that excess pressure does not build up. The glue is then allowed to harden and form a bonded tongue and groove joint by maintaining the members in contact for a sufficient time for hardening at room temperature or while heating in an oven at elevated temperature at a reduced time. One suitable glue which can be employed is a thermosetting plastic resin adhesive, such as phenol resorcinol glue. The resulting completed wooden I-beam or joist member is shown in FIGS. 1 and 2.

Figure 10:
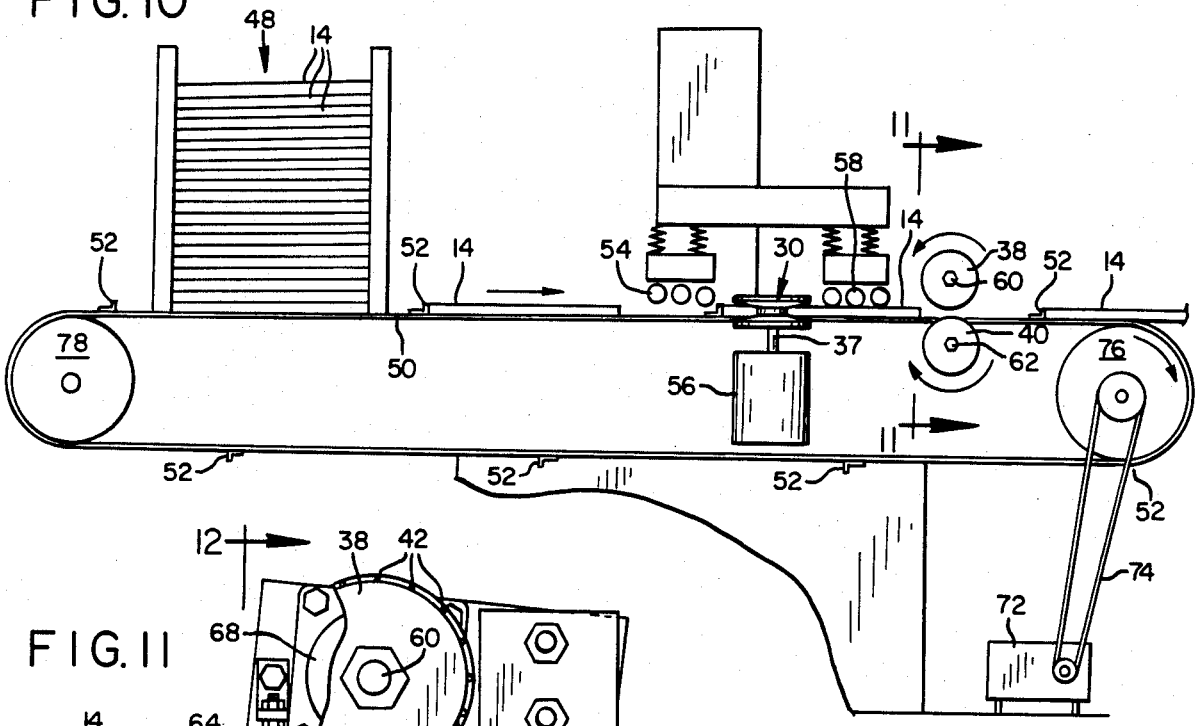
FIG. 10 is a side elevation view of a machine which may be employed in the method of manufacture to form the tapered edges on the opposite sides of the web member and to form the vent slots in such tapered edges when such web members are conveyed therethrough.
Figure 11:
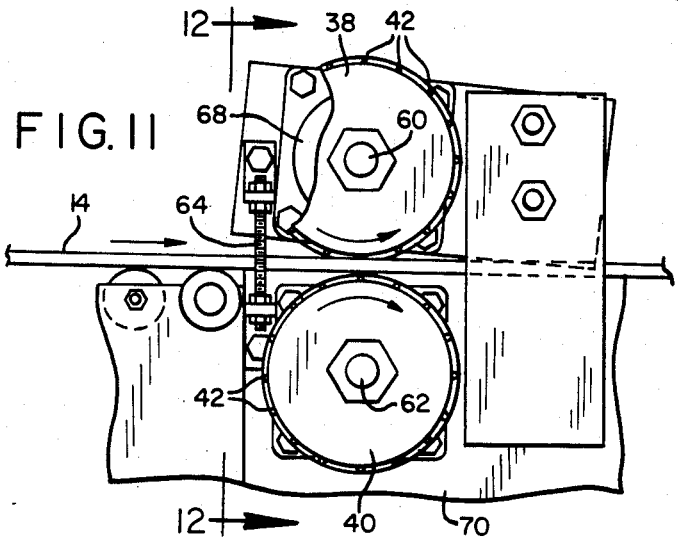
FIG. 11 is an enlarged vertical section view taken along the line 11—11 of FIG. 10 showing the two cutting rollers employed to form the vent slots in the web member.
Figure 12:
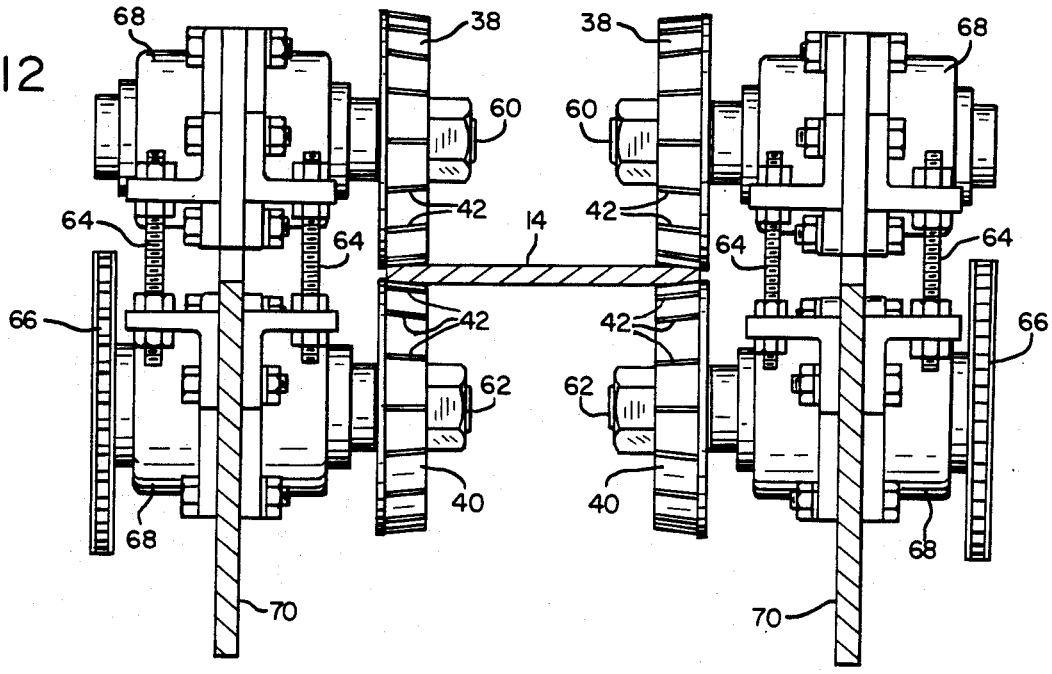
FIG. 12 is a vertical section view taken along the line 12—12 of FIG. 11.

With the method of manufacture of the present invention, the web member 18 is first cut to form the tapered edges 18 and to provide the vent slots 26 by the cutter head 30 of FIG. 7 in one step using the apparatus shown in FIGS. 10, 11 and 12. In such apparatus a stack 48 of web members 14 are supported above a conveyor belt 50 having dogs 52 fastened thereto spaced apart by sufficient distance to feed one web member at a time from the bottom of the stack. The web members 14 are transmitted beneath pressure rolls 54 which urge the web members downward into contact with the conveyor 50 and conveyed through a pair of cutter heads 30. Each cutter head is rotated about shaft 37 by means of a motor 56. As a result, the tapered edges 18 on the opposite sides of the web member are cut by the cutter heads 30. Then the web member 14 with tapered edges is fed beneath a second set of pressure rollers 58 and between the vent slot cutter rolls 38 and 40. The cutter rolls rotate about horizontal shafts 60 and 62, respectively, in a counterclockwise direction in the case of upper roll 38 and a clockwise direction in the case of lower roll 40. Thus, the rotation of the cutter rolls 38 and 40 also tends to propel the web member 14 through such cutter rolls along the conveyor belt. It should be noted that there are two pairs of cutter rolls 38, 40 on opposite sides of the web member 14 in order to cut vent slots 26 in both edges of the web member, as shown in FIG. 12. The spacing between the upper and lower cutter rolls 38 and 40 is adjusted by means of a plurality of threaded bolts 64 secured to the housings 68 of the bearings for the shafts 60 and 62. Drive chains 66 coupled to the conveyor 52 are connected to the lower cutter shaft 62 for driving it in the clockwise direction shown in FIGS. 10 and 11. The bearing housings 68 of the shafts 60 and 62 are bolted through vertical adjustment slots (not shown) to a support plate 70. The conveyor belt 50 is driven by a conveyor motor 72 coupled by a coupling chain 74 connected to a conveyor drive roll 76 at the output end of the conveyor. The input end of the conveyor is carried by an idler wheel 78.

After discharge from the output of the conveyor 50, the tapered and slotted web members are then each inserted laterally into the grooves 16 of a pair of flange members 10 and 12, such grooves being cut in a conventional manner by a router mechanism (not shown). However, before assembly, the grooves 16 are coated with three beads 28 of glue on each of their opposite sides by a pressurized glue applicator head which has six glue nozzle openings and is moved longitudinally along the full length of the groove. Then the glue is allowed to dry and harden at room temperature to form a bonded tongue and groove joint of great strength between the tapered edges 18 of the web member 14 and the groove 16 of the flange members 10 and 12. Any excess glue is allowed to escape from the groove 16 through the vent slots 26 in the tapered edges 18. The resulting wooden I-beam or joist shown in FIG. 1 is stronger and capable of supporting greater loads.

It will be obvious to those having ordinary skill in the art that many changes may be made in the preferred embodiment of the invention. For example, the vent slots 26 could be formed in the sides of the groove 16 after the routing of such groove rather than in the sides of the tapered edge 18. Therefore, the scope of the invention is to be determined by the following claims.

I claim:

1. A wooden structural member, comprising:

a pair of spaced wooden flanges each having a groove extending longitudinally thereof in alignment with and facing the groove of the other flange, said groove being tapered in width and of substantially uniform cross section along at least the majority of its length;

adhesive bonding material provided in uncompressed wood within said grooves;

a wooden web of oriented strand board having two opposite edges secured within the grooves of said flanges by the adhesive bonding material, said opposite edges each being cut with a tapered width which reduces with distance toward an outer end of the tapered edge and formed of substantially uncompressed wood which is not compressed beyond its elastic limit; and vent slots spaced longitudinally along the grooves and provided in uncompressed wood between the mating surfaces of the web edge and the flange groove, said vent slots extending to the top of the grooves to allow said bonding material to vent out of said grooves through said vent slots.

2. A member in accordance with claim 1 in which the vent slots are formed of a substantially uniform depth along their length in the tapered opposite edges of the web.

3. A member in accordance with claim 2 in which the vent slots are formed with a substantially uniform width and extend the entire height of the tapered edge in which they are formed.

4. A member in accordance with claim 1 in which the vent slots are formed in the tapered non-compressed opposite edges of the web.

5. A member in accordance with claim 1 in which the flanges are made of laminated veneer lumber.

6. A member in accordance with claim 1 in which the taper of the web edges is greater than the taper of the groove.

7. A member in accordance with claim 6 in which the tapered web edge is of greater width than the width of the groove to provide an interference fit so that the web is clamped in the flange groove.

8. A member in accordance with claim 1 in which the outer end of the tapered web edge is spaced from the bottom of the groove.

9. A member in accordance with claim 1 in which the adhesive bonding material is a wood glue which is provided on the sides of the tapered grooves.

* * * * *

UNITED STATES PATENT AND TRADEMARK OFFICE

CERTIFICATE OF CORRECTION

PATENT NO. : 4,715,162

DATED : December 29, 1987

INVENTOR(S) : LIONEL L. BRIGHTWELL

It is certified that error appears in the above-identified patent and that said Letters Patent is hereby corrected as shown below:

Column 4, line 3, "2.14 inch" should not be in bold numerals.

Column 4, line 24, "5/8 inches" should be --5/8 inch--.

Column 4, line 57, "rollers" should be --rolls--.

Column 6, claim 1, lines 22 and 23, delete "in uncompressed wood".

Signed and Sealed this

Twenty-sixth Day of July, 1988

*Attest:*

DONALD J. QUIGG

*Attesting Officer*

*Commissioner of Patents and Trademarks*